US012747537B2

(12) United States Patent
Breitholtz et al.

(10) Patent No.: US 12,747,537 B2
(45) Date of Patent: Sep. 29, 2026

(54) CELLULOSIC FIBER MATERIAL AND PROCESS

(71) Applicant: Papershell AB, Tibro (SE)

(72) Inventors: Anders Breitholtz, Västra Frölunda (SE); Mathieu Gustafsson Aplehag, Hägersten (SE)

(73) Assignee: Papershell AB, Tibro (SE)

( * ) Notice: Subject to any disclaimer, the term of this patent is extended or adjusted under 35 U.S.C. 154(b) by 76 days.

(21) Appl. No.: 18/577,541

(22) PCT Filed: Jul. 6, 2022

(86) PCT No.: PCT/EP2022/068740
§ 371 (c)(1),
(2) Date: Jan. 8, 2024

(87) PCT Pub. No.: WO2023/280918
PCT Pub. Date: Jan. 12, 2023

(65) Prior Publication Data

US 2024/0384475 A1 Nov. 21, 2024

(30) Foreign Application Priority Data

Jul. 7, 2021 (EP) ..... 21184323
Nov. 16, 2021 (SE) ..... 2151397-3

(51) Int. Cl.
*D21H 27/30* (2006.01)
*D21H 21/10* (2006.01)
*D21H 23/24* (2006.01)

(52) U.S. Cl.
CPC ..... *D21H 27/30* (2013.01); *D21H 21/10* (2013.01); *D21H 23/24* (2013.01)

(58) Field of Classification Search
CPC ..... D21H 27/30; D21H 21/10; D21H 23/24
(Continued)

(56) References Cited

U.S. PATENT DOCUMENTS 3,791,783 A * 2/1974 Damon ..... B29C 41/042 19/0.56
4,616,991 A * 10/1986 Bach ..... B30B 5/00 264/118

(Continued)

FOREIGN PATENT DOCUMENTS

CN 101535567 A 9/2009
CN 105075409 A 11/2015

(Continued)

OTHER PUBLICATIONS

Machine_English_translation_JP_2013035969_A; Mae Kazuhiro et al.; Method for Producing Lignin Derivative; Feb. 21, 2013; EPO; whole document (Year: 2025).*

(Continued)

*Primary Examiner* — Tahseen Khan
(74) *Attorney, Agent, or Firm* — Harness, Dickey & Pierce, P.L.C.

(57) ABSTRACT

The present invention relates to a cellulosic fiber substrate, comprising at least one top surface and at least one bottom surface. The cellulosic fiber substrate further comprises 60 to 90 wt % of cellulosic fibers having a length of maximum 10 mm, 0 to 10% of an acidic curing catalyst and 10 to 40 wt % of a binding agent selected form the group consisting of: cellulose, hemicellulose, furan, lignin and combinations thereof.

19 Claims, 6 Drawing Sheets

(58) Field of Classification Search
USPC ..... 428/156
See application file for complete search history.

(56) References Cited

U.S. PATENT DOCUMENTS

| | | | | |
|---|---|---|---|---|
| 5,476,617 | A * | 12/1995 | English | B27N 5/00 264/319 |
| 2002/0100566 | A1* | 8/2002 | Lee | B32B 27/20 162/166 |
| 2008/0197536 | A1* | 8/2008 | Fujii | B27N 5/00 264/320 |
| 2009/0264036 | A1* | 10/2009 | Yano | H05K 1/0366 162/1 |
| 2013/0149511 | A1 | 6/2013 | Riebel et al. | |
| 2016/0130412 | A1 | 5/2016 | Biesalski et al. | |
| 2016/0229088 | A1 | 8/2016 | Ojala et al. | |
| 2016/0297962 | A1* | 10/2016 | Nelson | C08J 3/005 |
| 2017/0266839 | A1* | 9/2017 | Batty | B27N 3/002 |
| 2019/0118426 | A1* | 4/2019 | Larsson | B29C 43/20 |
| 2020/0032456 | A1 | 1/2020 | Paulson et al. | |
| 2021/0024706 | A1* | 1/2021 | Mayes | D04H 1/558 |
| 2024/0026608 | A1* | 1/2024 | Berglund | D21H 15/00 |

FOREIGN PATENT DOCUMENTS

| | | | | |
|---|---|---|---|---|
| DE | 102006014049 | A1 * | 10/2007 | B29C 53/04 |
| JP | H05-140900 | A | 6/1993 | |
| JP | H08-188979 | A | 7/1996 | |
| JP | 2013035969 | A * | 2/2013 | |
| JP | 2013-536896 | A | 9/2013 | |
| JP | 2014-152290 | A | 8/2014 | |
| JP | 2016-525149 | A | 8/2016 | |
| JP | 2018150465 | A * | 9/2018 | |
| KR | 10-2017-0044190 | A | 4/2017 | |
| KR | 101989854 | B1 | 9/2019 | |
| WO | WO-2014175196 | A1 * | 10/2014 | B27N 3/04 |
| WO | WO-2018183335 | A1 | 10/2018 | |
| WO | 2021/038511 | A1 | 3/2021 | |
| WO | WO-2021053186 | A1 * | 3/2021 | D21H 17/28 |

OTHER PUBLICATIONS

Machine_English_translation_WO_2014175196_A1; Kakutani et al.; Solder-Resist Composition and PCB Using Same; Oct. 30, 2014; EPO; whole document (Year: 2025).*

Machine_English_translation_DE_102006014049_A1; Vauer et al.; Method for producing a structured plastic component; Oct. 11, 2007; EPO; whole document (Year: 2025).*

Machine_English_translation_JP_2018150465_A1;Ogasawara et al.; furan Resin composition; Sep. 27, 2018; EPO; whole document ( Year: 2025).*

International Search Report and Written Opinion for International application No. PCT/EP2022/068740 dated Oct. 7, 2022.

Kumar Rakesh et al. "Compression-moulded flax fabric-reinforced polyfurfuryl alcohol bio- composites: Mechanical and thermal properties", Journal of Thermal Analysis and Calorimetry, vol. 112, No. 2, Aug. 26, 2012 (Aug. 26, 2012), pp. 755-760.

Japanese Office Action dated Mar. 22, 2025 issued in corresponding Japanese Patent Appln. No. 2023-580975 (English translation).

Korean Office Action dated Dec. 11, 2025 for corresponding Korean Application No. 10-2024-7004023.

Chinese Office Action dated Jul. 1, 2026 for corresponding Chinese Application No. 202280046194.1.

* cited by examiner

| Standard: | ISO 527 | | | | | | |
|---|---|---|---|---|---|---|---|
| Speed: | 2mm/min | | | | | | |
| | | | | | | | |
| Specimen label | Maximum Load [kN] | Tensile stress at Maximum Load [MPa] | Strain 1 at Maximum Load [%] | Modulus [GPa] | Thickness [mm] | Width [mm] | |
| 1 | 0,85 | 46,09 | 0,61 | 8,07 | 1,83 | 10,05 | 4,41 |
| 2 | 4,32 | 185,03 | N/A | 18,6 | 2,48 | 9,41 | 7,5 |
| 3 | 4,88 | 201,45 | 1,81 | 19,1 | 2,49 | 9,72 | 7,67 |
| 4 | 4,80 | 193,32 | N/A | 18,4 | 2,49 | 9,98 | 7,4 |
| 5 | 8,55 | 164,43 | N/A | 19,1 | 4,96 | 10,48 | 3,8 |
| 6 | 9,55 | 204,87 | 1,22 | 20,8 | 4,91 | 9,52 | 4,2 |
| **Average** | **5,49** | **165,87** | **1,21** | **17,34** | | | |
| **Std** | **3,15** | **60,43** | **0,77** | **4,62** | | | **5,8** |
| **CV** | **57,44** | **36,43** | **63,07** | **26,64** | | | |
| | | | | | | | |
| | | | | | | | |
| | | | | | | | |

CELLULOSIC FIBER MATERIAL AND PROCESS

CROSS-REFERENCE TO RELATED APPLICATIONS

This application is a national phase under 35 U.S.C. § 371 of PCT International Application No. PCT/EP2022/068740 which has an International filing date of Jul. 6, 2022, which claims priority to European Patent Application No. 21184323.0, filed Jul. 7, 2021, and Swedish Patent Application No. 2151397-3, filed Nov. 16, 2021, the entire contents of each of which are hereby incorporated by reference.

TECHNICAL FIELD

The present invention relates to a cellulosic fiber thermoset material and a process of manufacturing said cellulosic fiber thermoset material.

BACKGROUND

In view of the growing awareness of the negative environmental impacts of global warming and pollution of sea and soil, it is a necessity to replace pure fossil-based plastics, mineral filled plastics and fiber reinforced plastics (FRP), glass fiber reinforced plastics (GFRP) and carbon reinforced plastics (CFRP), more with environmentally friendly alternatives. FRP composites such as GFRP and or CFRP composites, exhibit a high or very high strength-to-weight ratio, and is extremely rigid due to the pronounced length and strength of the manmade non-degradable fibers. These FRP composites are often used in various applications where e.g., flexural strength, impact resistance and/or weather resistance is of importance, like in vehicles, in protective sport appliances, buildings, electric housing and the like. However, the environmental impact of these materials is high in both manufacturing of raw materials like glass or carbon fiber, production of an intermediate of the same, and disposal and/or recycling. Attempts have been made to replace fossil-based polymers in GFRP and CFRP materials with more environmentally friendly alternatives, e.g., bio based or bio attributed polymers. Further, attempts have been made to replace the glass or carbon fiber with natural fibers such as flax, hemp, sisal etc. However, the major challenge for both bio based and/or bio attributed, and renewable and/or natural fiber alternatives for GFRP and CFRP composites is the high price point, lack of sufficient volumes and consistency of quality in supply that can compete with the fossil-based polymers and manmade fibers.

Natural fiber composites (NFC) are divided into non-wood fiber-based composites and wood fibers and wood particles-based composites. Wood fibers are often shorter in length than other natural fibers like jute or flax. Due to the greater length of the non-wood fibers (natural fibers) e.g., the potential in flexural strength driven applications is greater than with the wood fibers and/or wood particles. Theses fibers often have high (>50%) cellulose with high tendency to be hydrophilic and generating problems such as natural rotting process, dimensions instability, delaminating and other problems due to climate cycling (moisture and temperature). To address these problems the NFC industry needs to saturate the composites with binders that often are fossil based such as thermosets och thermoplastics where >20% bio content is considered high in such systems. Meaning that these natural fibers are combined with fossil-based systems which is bad for the environment and very problematic to recycle or separate.

A large and stable renewable resource of cellulosic fibers is from the Forrest industries coming from different wood species, such as conifer or eucalyptus, in the pulp and paper production. Recently, a number of NFC materials have been produced combining cellulosic fibers from forests and polymers to decrease the environmental impacts and yet create load-bearing articles. Such materials are usually manufactured by mixing and compounding pure wood fibers or fibers form pulp and paper production into granulates for injection molding, wherein the final article is thus not based on layered sheets.

A well-known solution of creating load-bearing 3D single curved, or developable, solutions based on cellulosic fibers is wood veneer that comprises layers, wherein the long wood fibers in each layer are often placed perpendicularly to the wood fibers in the adjacent layers, and wherein the layers are heat-pressed in a single curved shape, such as a seat for a chair. For more complex 3D surfaces, such as double curved, or non-developable, surfaces, special and expensive 3D veneer or plastics is the only option, since the traditional veneer will tear and break at attempts to create a double-curved surface.

Another well-known example of using short cellulose fibers found in paper is to create flat load-bearing applications using high pressure laminate or HPL, consisting of several different layers of paper and surface materials, as well as polymer or phenolic binders. Although some special and exotic grades of HPL can be post-formed around single curved edges by application of heat and restraint and using a thermoplastic binder that can be post formed, HPL has never been used for manufacturing articles having complex 3D non-developable surface including combinations of single curve, double curve and/or revolutions and translations, e.g. a load bearing spheric shape for a helmet, cylindrical revolved surface for a vase or the complex surfaces for a hull of a boat.

In both examples above, indoor use is the intended use as natural fibers are hydrophobic and/or degrade with UV. In the case of HPL, the outmost layers oftentimes have a special coating with for increased scratch, UV and moisture resistance, as well as decorative looks, e.g., imitations of marble or wood. Such a material may for example be used as a countertop or a stack of laminate floor.

Another option to create complex 3D load-bearing articles comprising layers of fibers from a renewable natural source and having a high tensile and flexural strength is using long cellulosic fibers such as hemp, flax, ramie, and sisal. Such fibers may be weaved info flat yet 2D flexible mats/fabrics impregnated with a binder. These materials are frequently used for providing flat and 3D structures having advantageous mechanical properties. Here, the length of the fibers is of a paramount importance, wherein each fiber is placed on the complex 3D surface. This process is expensive, and the source of harvested fibers competes with food and textile industry. Another challenge is that the long natural fibers are hydrophilic, thus absorbing moisture and making them unsuitable for outdoor use and wet spaces. Also, the need of polymer binders still makes these natural fiber composites, just like any composites comprising polymers, difficult or impossible to recycle, thus disrupting plastics recycling loops.

Finally, it is known to combine cellulosic fibers with polymeric materials, such as thermoplastics, in order to manufacture a granulate for injection molding, extrusion and blow and press molding. Although the thermoplastic material may be bio-based and biodegradable, such a material is rather expensive and the bio-based solutions have inferior properties to fossil based resin systems. And there is an ongoing debate whether NCFs and bio based polymers, which in turn are based on crops grown in fields, compete with agriculture land needed for food production. Also in several cases the need for fertilisers and the low yield has shown that so called bio plastics have negative overall environmental impacts. On top of this you have the uncertainties of weather affecting harvests from year to year creating fluctuations in price.

Considering the challenges currently existing in the technical field, it is desired to provide cellulosic fiber substrates comprising natural and renewable components having low environmental impact, while obtaining mechanical properties being comparable with fibers composites such as GFRP, fossil based polymers and even metals such as aluminium. Further, it is desirable to provide a material and a process for obtaining such a substrate. As well as creating solutions for large scale production by 1) using a stable and process industry based large scale non food competing bio based raw material source 2) creating properties that enables highly automatic production processes by reducing problems such as wet and sticky solutions hard to incorporate in internal logistic, robotics systems etc which often is the case for manual intens Fiber composites solutions on the market.

SUMMARY

In view of the above, the present invention aims to solve at least some of the problems/gaps of the prior art. To this end, the present invention provides a cellulosic fiber material and a production process thereof. The cellulosic fiber material, which is based on renewable natural resources, comprises a surface, wherein the surface has at least one developable and/or non-developable surface portion.

The cellulosic fiber substrate according to the present invention, comprises at least one top surface, at least one bottom surface, and is characterized in that, the cellulosic fiber substrate further comprises 60 to 90 wt % of cellulosic fibers having a length of maximum 10 mm, 0 to 10% of an acidic curing catalyst and 10 to 40 wt % of a binding agent selected form the group consisting of cellulose, hemicellulose, furan, lignin and combinations thereof.

In one embodiment, a cellulosic fiber substrate is provided, wherein the binding agent is polyfurfuryl alcohol (PFA).

In one embodiment, a cellulosic fiber substrate is provided, wherein said cellulosic fibers comprise from 0-100% virgin cellulosic fibers and 0-100% recycled cellulosic fibers.

In one embodiment, a cellulosic fiber substrate is provided, wherein the at least one top surface and/or bottom surface has at least one developable and/or non-developable surface portion.

In one embodiment, a cellulosic fiber substrate is provided, wherein said cellulosic fibers in the substrate are arranged substantially parallel, or wherein said cellulosic fibers in the substrate are arranged substantially criss-crossed, or wherein said cellulosic fibers in the substrate are arranged substantially random or arranged in a combination thereof.

In one embodiment, a cellulosic fiber substrate is provided, wherein the substrate comprises at least one cavity.

A load bearing 3D article according to the present invention comprises the cellulosic fiber substrate according to the present invention.

In one embodiment, a load bearing 3D article is provided, wherein the load bearing article has a tensile strength least of at least 40 MPa, preferably at least 50 MPa, more preferably at least 100 MPa.

In one embodiment, a load bearing 3D article is provided, wherein the load bearing article has a thickness of at least 2.5 mm, preferably at least 5 mm, more preferably at least 10 mm.

A method for manufacturing a cellulosic fiber substrate comprising at least one top surface and one bottom surface according to the present invention comprises the steps of:

a) providing at least one sheet of cellulosic fibers having a maximum length of 10 mm;
b) impregnating the at least one sheet of cellulosic fibers with a mix of an acidic curing catalyst and a binding agent selected form the group consisting of: cellulose, hemicellulose, furan, lignin and combinations thereof, to obtain at least one sheet of impregnated cellulosic fibers;
c) pre-curing the at least one sheet of impregnated cellulosic fibers by applying heat in the range of 50-300° C., thus obtaining a prepreg;
d) arranging one or more prepregs in a stack;
e) pressing said stack in a pressing tool at a pressure of at least 7 kg/cm2, preferably at least 25 kg/cm2, more preferably at least 30 kg/cm2 and the temperature of at least 60° C., preferably at least 140° C., more preferably at least 150° C. during a time period of at least 10 seconds, preferably at least one minute, more preferably at least two minutes, thus obtaining a cellulosic fiber substrate having at least one top surface and one bottom surface.

In one embodiment, a method for manufacturing a cellulosic fiber substrate is provided, wherein the binding agent is polyfurfuryl alcohol (PFA).

In one embodiment, a method for manufacturing a cellulosic fiber substrate is provided, wherein the cellulosic fibers comprise a mix of 0-100% virgin cellulosic and 0-100% recycled cellulosic fibers.

In one embodiment, a method for manufacturing a cellulosic fiber substrate is provided, wherein the cellulosic fibers are provided in the form of paper.

In one embodiment, a method for manufacturing a cellulosic fiber substrate is provided, wherein the top and/or bottom surface has at least one developable and/or non-developable surface portion.

In one embodiment, a method for manufacturing a cellulosic fiber substrate is provided, wherein said cellulosic fiber substrate has an amount of biobased carbon of at least 80%.

In one embodiment, a method for manufacturing a cellulosic fiber substrate is provided, wherein said cellulosic fiber substrate comprises from 60 to 90 wt % of said cellulosic fibers.

In one embodiment, a method for manufacturing a cellulosic fiber substrate is provided, wherein said cellulosic fiber substrate comprises from 10 to 40 wt % of said binding agent.

In one embodiment, a method for manufacturing a cellulosic fiber substrate is provided, wherein said cellulosic fiber substrate comprises from 0 to 10 wt % of said acidic catalyst.

In one embodiment, a method for manufacturing a cellulosic fiber substrate is provided, wherein the prepregs in the stack are oriented such that the grain directions in the prepregs are substantially parallel.

In one embodiment, a method for manufacturing a cellulosic fiber substrate is provided, wherein the prepregs in the stack are oriented such that the angle of the grain directions in the prepregs range from 0-90° with respect to the neighboring prepregs.

In one embodiment, a method for manufacturing a cellulosic fiber substrate is provided, further comprising step f) of cutting the prepreg and/or the cellulosic fiber substrate into a pre-determined shape.

In one embodiment, a method for manufacturing a cellulosic fiber substrate is provided, further comprising step g) of creating cavities in the cellulosic fiber substrate.

Further features of, and advantages with, the present invention will become apparent when studying the appended claims and the following description. The skilled person realizes that different features of the present invention may be combined to create embodiments other than those described in the following, without departing from the scope of the present invention.

BRIEF DESCRIPTION OF THE DRAWINGS

These and other aspects of the present invention will now be described in more detail, with reference to the appended drawings showing embodiments of the invention, of which.

DETAILED DESCRIPTION OF THE PRESENT INVENTION

Figure 1A:
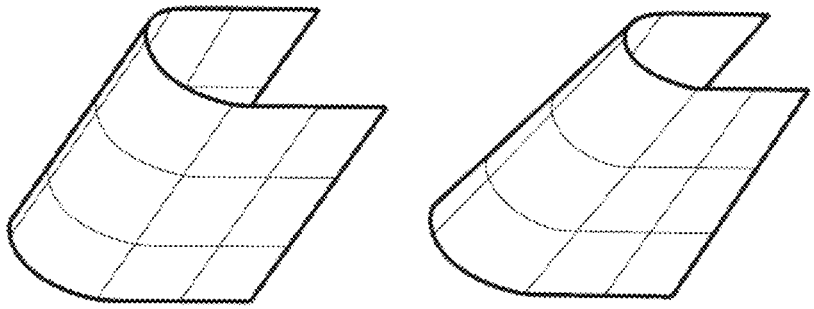
FIGS. 1*a*-1*c* depict examples of surfaces of cellulosic fiber substrates according to the present invention.

The present invention will now be described hereinafter with reference to the accompanying drawings, in which exemplifying embodiments of the present invention are shown. The present invention may, however, be embodied in many different forms and should not be construed as limited to the embodiments of the present invention set forth herein; rather, these embodiments of the present invention are provided by way of example so that this disclosure will convey the scope of the invention to those skilled in the art. In the drawings, identical reference numerals denote the same or similar components having a same or similar function, unless specifically stated otherwise.

As mentioned above, the cellulosic fiber substrate comprises cellulosic fibers having a length of maximum 10 mm. Cellulosic fibers are made with ethers or esters of cellulose, which can be obtained from the bark, wood or leaves of plants, or from other plant-based material. Cellulosic fibers may be derived from the conversion of wood into wood pulp. The length of each cellulosic fiber in the composite material may be same as or different from the length of the other cellulosic fibers. Indeed, it is conceivable that some of the cellulosic fibers may have a length being greater than 10 mm, but the amount of these fibers should be considered negligible. By the term "negligible" is understood as an amount below 0.01 wt %. Cellulosic fibers may be provided in any suitable form, such as sheets, rolls, batting or the like. The cellulosic fibers that may be used for manufacturing the cellulosic fiber substrate according to the present invention can be recycled cellulosic fibers, which offers the advantage of decreasing the cost of the cellulosic fiber substrate and contributing to a circular economy. On the other hand, the cellulosic fibers may be virgin cellulosic fibers, which provides an increased tensile and/or flexural strength of the circuit board compared to when recycled cellulosic fibers are used. Further, it is conceivable that the cellulosic fibers is a mixture of recycled and virgin cellulosic fibers in a range of 0-100% virgin cellulosic fibers and 0-100% recycled cellulosic fibers respectively. The cellulosic fibers may comprise paper, e.g. softwood kraft paper, hardwood kraft paper, sulfite fibers, organosolv fibers, non-woven or combinations thereof. It is conceivable that the cellulosic fibers comprise from 50 to 90 wt % of the kraft paper. The paper may be provided in the form of sheets and/or in the form of continuous sheets, e.g. paper rolls. The cellulosic fiber substrate of the present invention may comprise from 40 to 90 wt % of the cellulosic fibers and 10 to 40 wt % of the binding agent. The cellulosic fiber substrate may have an amount of biobased carbon of at least 80%, preferably at least 90%, more preferably at least 95%. The biobased carbon is derived in whole or in part from biomass resources. Biomass resources are organic materials that are available on a renewable or recurring basis such as crop residues, wood residues, grasses, and aquatic plants. On the contrary, non-biobased carbon is made entirely from petrochemical resources. The amount of biobased carbon referred to above is a measure of the amount of biobased carbon in the product as compared to the sum of biobased and petroleum-based carbon in the product. The term biobased carbon describes carbon of non-fossil origin and relates to the cellulosic fibers and/or binding agent and/or additives.

The cellulosic fiber substrate according to the present invention further comprises the binding agent selected form the group consisting of cellulose, hemicellulose, lignin, furan, preferably polyfurfuryl alcohol (PFA) and combinations thereof.

The cellulosic fiber substrate may comprise additives such as a catalyst, a UV-agent, a conducting compound, a pigment, a hydrophobic substance, a softener, a hardener, a curing agent, or the like. The catalyst may be an acidic catalyst, e.g. an inorganic or organic acid. The catalyst may be added in a range of 0-10 wt % and may have a pH value <5 and/or an acid number <5 mg KOH/g. The additive may be added in order to increase chemical, fire and wear resistance, and/or to increase curing speed, thus maximizing production.

Figure 8:
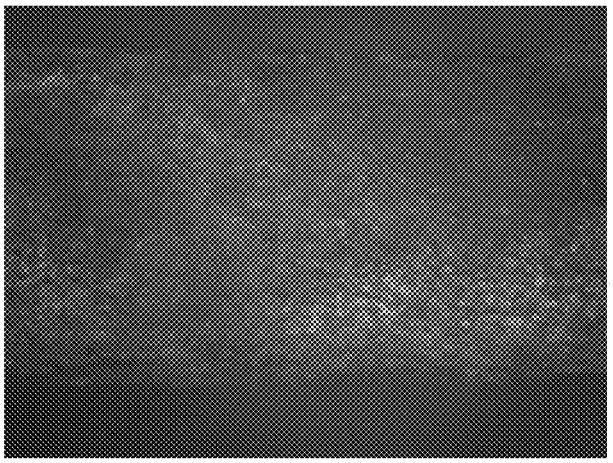
FIG. 8 shows a cross section of the substrate according to the present invention.

The prepreg material of the present invention surprisingly shows advantageous floating properties during the curing step most likely attributed to the relatively short fibers in combination with the binding agent having a certain viscosity. It is conceivable to add an alcohol, e.g. max. 20% ethanol or methanol in the process to further improve the floating ability. The term floating shall be understood as a property of the cellulosic fibers to be able to move and fill cracks and tearing that may appear during manufacturing of cellulosic fiber substrates. The floating properties enable the cellulosic fibers to adapt to the shape of a mold or tool during the manufacturing process. As shown in FIGS. 1 to 4, the floating properties enable the manufacturing of complex shapes, such as 3D shapes as well as flat surfaces and give control of micro surface structures, thus enabling tailored manufacturing of additional properties, such as surface properties, e.g. smooth and blank or matt and coarse surfaces. It is conceivable that the shapes manufactured according to the present invention may be flat, single curved, double curved, spherical, comples or with holes in it. FIGS. 3*a* and 3*b* illustrate how the single sheets of the prepregs are morphed into a single homogenous material of a curved structure. FIG. 8 shows a cross section through the cellulosic fiber substrate, it is not possible to distinguish the single layers of cellulosic fibers used during the manufacturing process. A property that is made possible due to the surprising floating effect of the short fibers in the manufacturing process according to the current invention. FIG. 3*a* illustrates an embodiment wherein the cellulosic fiber substrate is manufactured from three layers of prepreg. Each of the layers of prepregs comprise the cellulosic fibers and binding agent as described above. The layers have equal thickness.

Figure 1B:
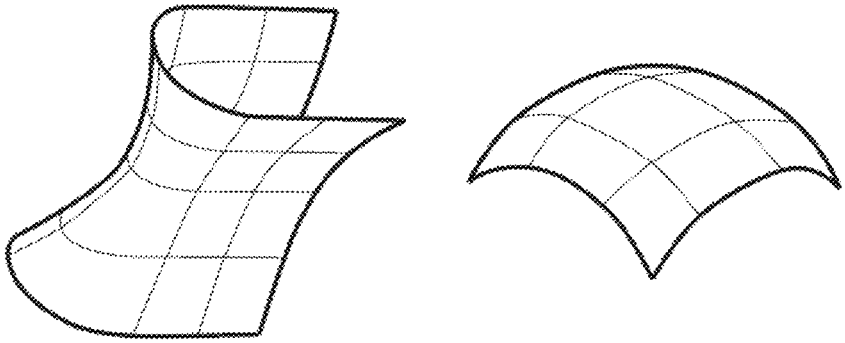
Figure 1C:
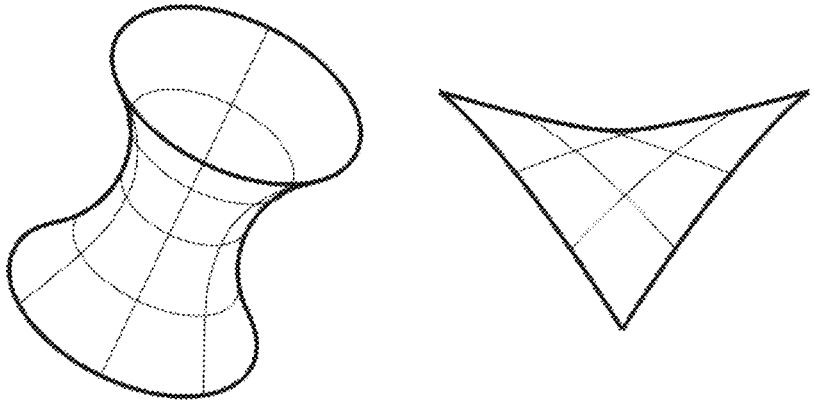

As mentioned above, the cellulosic fiber substrate comprises a surface, wherein the surface has at least one developable and/or non-developable surface portion. FIGS. 1*a*-1*c* illustrate various examples of such surfaces. In particular, FIG. 1*a* shows developable, or single-curved surfaces, while FIGS. 1*b* and 1*c* depict non-developable, or double-curved, surfaces.

Figure 2A:
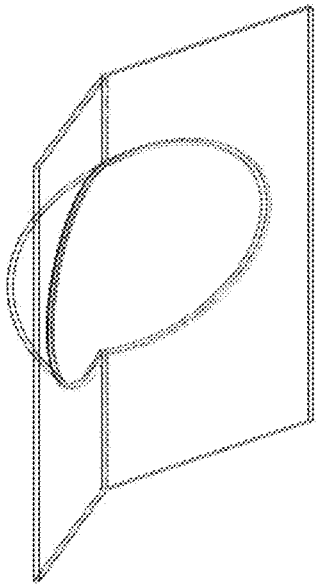
FIGS. 2*a*-2*e* illustrate another example of a surfaces of a cellulosic fiber substrate according to the present invention.
Figure 2B:
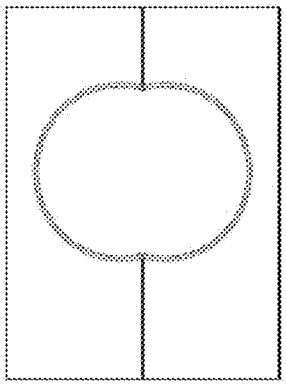
Figure 2C:
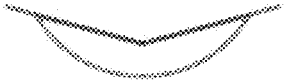
Figure 2D:
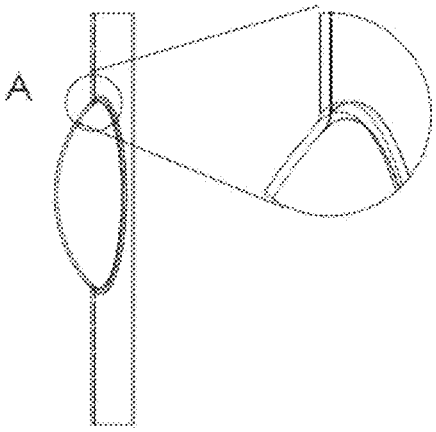
Figure 2E:
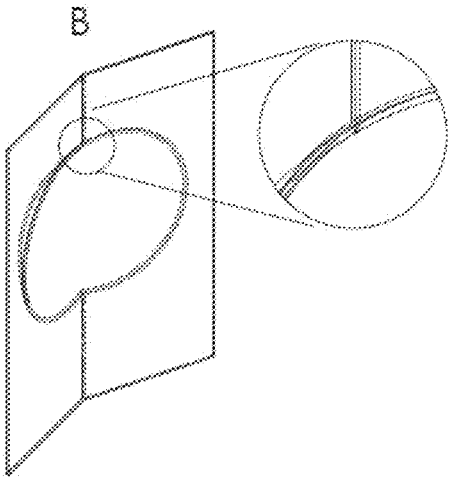
Figure 3A:
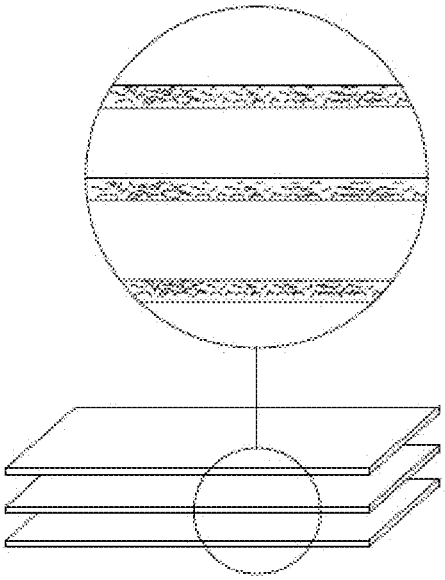
FIG. 3*a* shows three layers of prepreg material and FIG. 3*b* shows the cured cellulosic fiber substrate shaped to a curved surface.
Figure 3B:
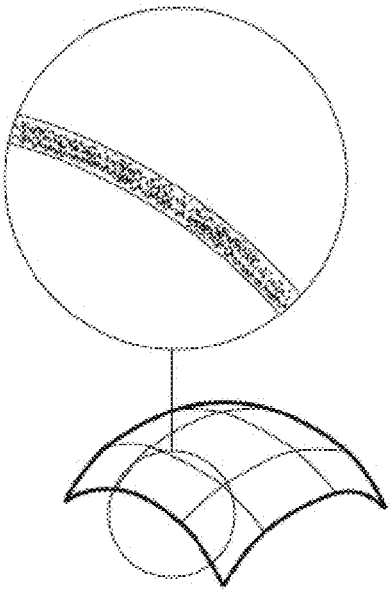

FIGS. 2*a*-2*e* illustrate another example of a surface comprising developable and non-developable surface portions. FIG. 2*a* is a perspective view of such a surface, while FIGS. 2*b* and 2*c* are front view and top view, respectively. As may be seen in FIGS. 2*d* and 2*e*, the surface depicted in FIG. 2*a* comprises non-developable portions A and B.

In the context of the present invention, a developable surface is a smooth surface with zero Gaussian curvature. A Gaussian curvature is defined as a product of two principal curvatures of a surface. Put differently, a developable surface is a non-flat surface that can be flattened onto a plane without distortion, i.e. it can be bent without stretching or compression. Conversely, it is a surface which can be made by transforming a plane by means of folding, bending, rolling, cutting and/or gluing. Examples of a developable surface are cylinders and cones.

On the contrary, a non-developable surface is a surface with non-zero Gaussian curvature. A non-developable surface is thus a non-flat surface that cannot be flattened onto a plane without distortion. Most of surfaces in general are non-developable surfaces. Non-developable surfaces may be referred to as doubly curved surfaces. One of the most often-used non-developable surfaces is a sphere.

Figure 4:
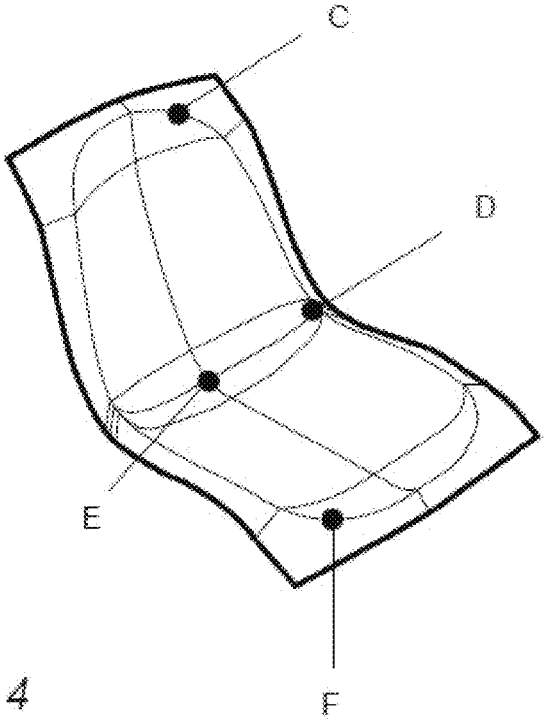
FIG. 4 illustrates an example of a cellulosic fiber substrate of the present invention.

FIG. 4 illustrates a cellulosic fiber substrate according to the present invention, wherein the cellulosic fiber substrate is a chair seat. As may be seen in FIG. 4, the chair seat comprises four portions C-F, which will be described in greater detail below.

Portion C comprises a complex non-developable 3D surface comprising the edge with arc and transition from double curved surface to single curved surface. Portion D comprises a non-developable complex 3D surface comprising the edge with arc and transition from extreme double curved surface to extreme single curved surface. Turning the attention to point E, a complex 3D edge is illustrated comprising a larger radius with double curved, i.e. non developable surface. Portion F comprises a complex 3D edge, wherein a sharp edge radius ($r<2$ mm) is maintained along all transitions between single and double curved surfaces.

The cellulosic fiber substrate of the present invention may have at least one portion comprising a radius of curvature being below 10 cm, preferably below 5 cm.

Cellulosic fibers are made with ethers or esters of cellulose, which can be obtained from the bark, wood or leaves of plants, or from other plant-based material. Cellulosic fibers may be derived from the conversion of wood into wood pulp. The length of each cellulosic fiber in the cellulosic fiber substrate may be same as or different from the length of the other cellulosic fibers. Indeed, it is conceivable that some of the cellulosic fibers may have a length being greater than 10 mm, but the amount of these fibers should be considered negligible. By the term "negligible" is understood as an amount below 0.01 wt %. Cellulosic fibers may be provided in any suitable form, such as sheets, pellets or the like.

The cellulosic fibers may be randomly oriented or may be oriented such that the longitudinal extensions of the fibers are substantially parallel.

The cellulosic fiber substrate of the present invention may comprise from 40 to 90 wt % of the cellulosic fibers and 10 to 40 wt % of a binding agent. The cellulosic fiber substrate according to the present invention further comprises the binding agent selected form the group of consisting of thermoset resins, reactive thermoplastic resins, cellulose, hemicellulose, lignin, bio-based polymers and combinations thereof. Thermoset resins may be substituted and non-substituted furan, epoxy, polyurethane, or phenolic resin. The reactive thermoplastic resins may have similar performance after curing as thermosets and may be in liquid or powder form. Such binding agents are readily available, cost-efficient, oftentimes biodegradable, and environmentally friendly. In particular, the binding agent is polyfurfuryl alcohol (PFA). Among bio-based polymers polylactic acid, the poly L-lactide, polyhydroxybuturate, polyhydroxyalkalonates (PHAs), polyamide, polypropylene (PP) and polyethylene terephthalate can be mentioned.

Figure 7:
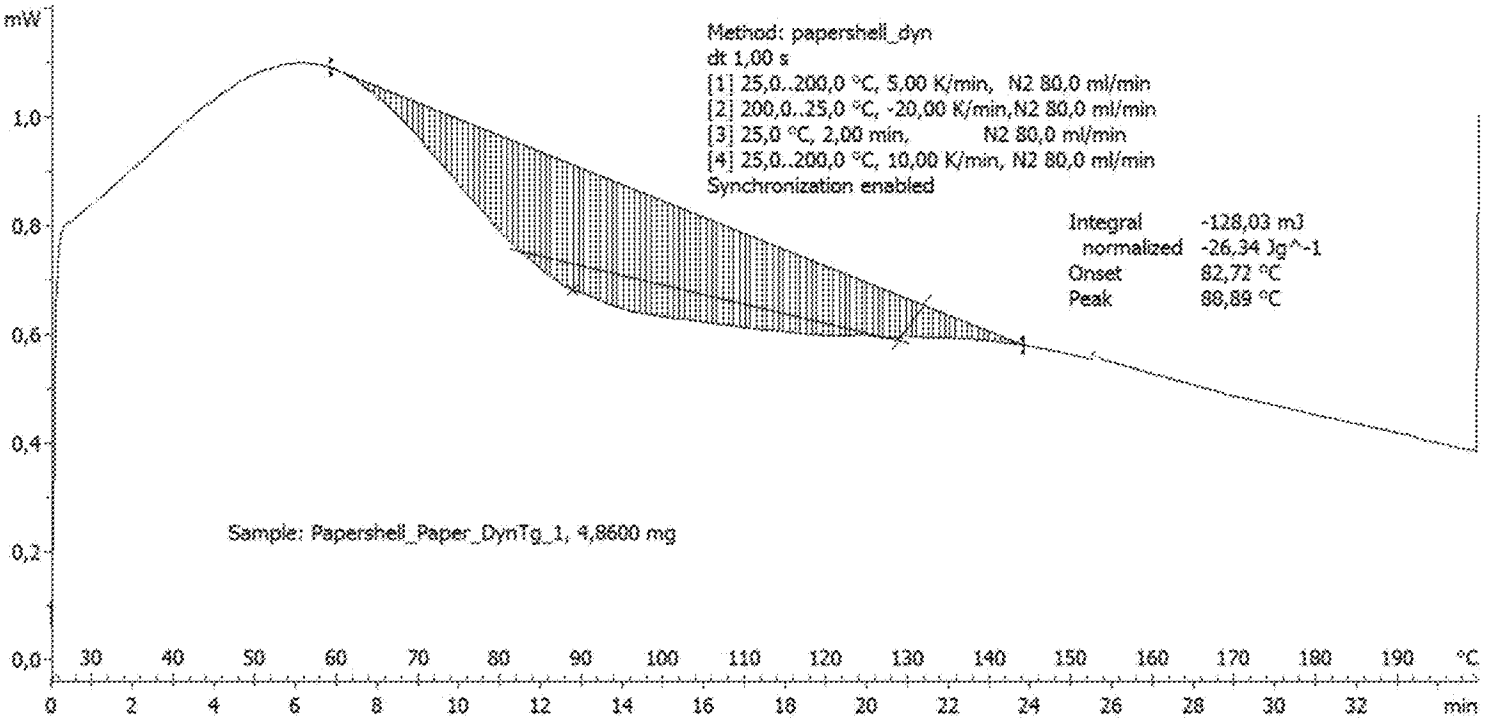
FIG. 7 shows a temperature diagram during the pressing step according to the present invention.

As mentioned above, it has surprisingly been found that the although the stack of prepregs constituting the cellulosic fiber substrate of the present invention comprises layers, the final cellulosic fiber substrate according to the present invention is perceived as being made of a homogenous cellulosic fiber substrate, as illustrated in FIG. 3*b* and FIG. 7. Without wishing to be bound by a theory, such an effected is believed to be achieved due to the length of the cellulosic fibers being below 10 mm, preferably below 4 mm. As mentioned above, the short hydrophilic cellulosic fibers are substantially completely impregnated by the binding agent. Further, when the stack of prepregs is subjected to a high pressure and formed into the cellulosic fiber substrate, almost no cracks are formed, since the cellulosic fibers may be rearranged without rupturing due to the short fiber length. Further, even if a crack appears in one of the layers of the stack of prepregs, it may be filled by the cellulosic fibers from at least one of the adjacent layers of the stack of prepregs. FIG. 8 shows a cross section through the cellulosic fiber substrate, it is not possible to distinguish the single layers of cellulosic fibers used during the manufacturing process. A property that is made possible due to the surprising floating effect of the short fibers in the manufacturing process according to the current invention.

The cellulosic fiber substrate according to the present invention has a tensile and/or flexural strength of at least 40 MPa, preferably at least 50 MPa, more preferably at least 100 MPa. The person skilled in the art immediately realizes that such a tensile and/or flexural strength is extremely surprising for an article comprising a cellulosic fiber substrate based on short cellulosic fibers. Such a high tensile and/or flexural strength exceeds the tensile and/or flexural strength of an article comprising a cellulosic fiber substrate based on wood and plastic and is comparable to the tensile and/or flexural strength obtained when using certain cellulosic fiber substrates.

Measurements of the mechanical properties of the substrate according to the present invention resulted in the following:

| | | |
|---|---|---|
| Tensile Modulus - 0° | 18 GPa | ASTM D3039M |
| Tensile Stress at Break - 0° | 150 MPa | ASTM D3039M |
| Tensile Strain at Break - 0° | 1% | ASTM D3039M |
| Tensile Modulus -90° | 10 GPa | ASTM D3039M |
| Tensile Stress at Break -90° | 90 MPa | ASTM D3039M |
| Tensile Strain at Break -90° | 1% | ASTM D3039M |
| Flexural Stiffness - 0° | 16.8 GPa | ASTM D7264 |
| Flexural Failure Stress - 0° | 156 MPa | ASTM D7264 |
| Flexural Failure Strain - 0° | 1% | ASTM D7264 |
| Compression Stiffness - 0° | 17.9 GPa | ASTM D6641 |
| Compression Failure Stress - 0° | 154 MPa | ASTM D6641 |
| Compression Failure Strain - 0° | >4% | ASTM D6641 |
| Compression Stiffness -90° | 10.3 GPa | ASTM D6641 |
| Compression Failure Stress -90° | 146 MPa | ASTM D6641 |
| Compression Failure Strain -90° | >4% | ASTM D6641 |

Figure 5:
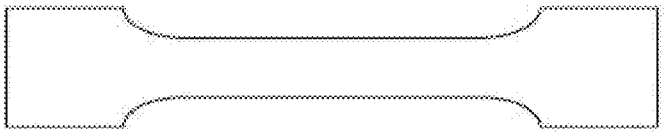
FIG. 5 depicts a tensile strength test of the cellulosic fiber substrate.
Figure 6:
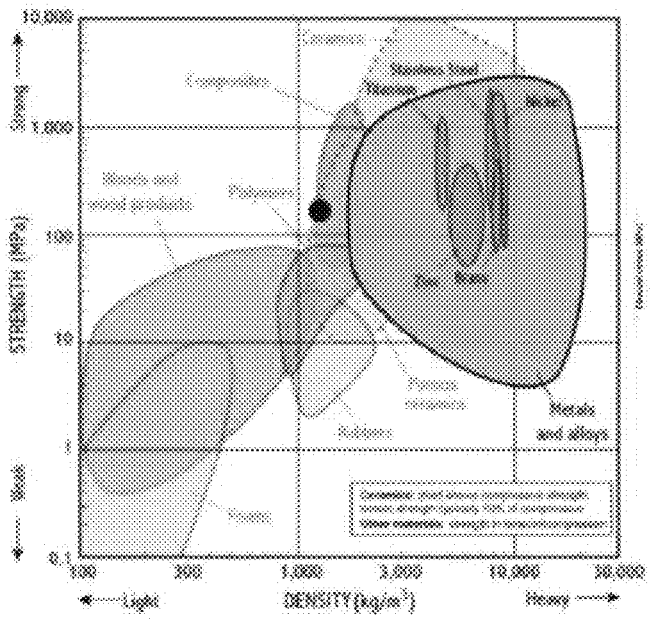
FIG. 6 shows comparative data of the tensile strength of the cellulosic fiber substrate analyzed in FIG. 5 in relation to other materials.

FIG. 5 illustrates the results of a tensile strength test according to ISO 527. Six different specimens having different thickness where tested. As may be seen in the table shown in FIG. 5, the average tensile strength was measured to be 166 MPa, which clearly exceeds the tensile strength of wood and wooden material, and is comparable with porous ceramics and composites, such as GFRP (FIG. 6).

One of the reasons for the high tensile and/or flexural strength of the cellulosic fiber substrate of the present invention is believed to be a good adhesion between the fibers and the binding agent. The binding agent contributes to internal mechanical cross-linking of the fibers to each other, such that the fibers are caught and locked in each other, thus contributing to the tensile and/or flexural strength of the cellulosic fiber substrate.

Another reason for the high tensile and/or flexural strength of the cellulosic fiber substrate is the possibility to determine fiber orientation in the 3D article during manufacturing.

The cellulosic fibers may be randomly oriented or may be oriented such that the longitudinal extensions of the fibers are substantially parallel or substantially crisscrossed. To this end, the fibers may be positioned such that the longitudinal extension of the major portion of the fibers (the grain direction) is aligned in the same direction. This may be achieved by arranging one or more prepregs in a stack, in a certain direction. In particular, the at least one prepreg may be oriented such that the grain direction of the cellulosic fibers in the at least one prepregs are substantially parallel to the grain direction of the cellulosic fibers of the other of the at least one prepregs. It has been shown that the tensile and/or flexural strength in the direction being parallel to the grain direction is significantly higher compared to the tensile and/or flexural strength in the direction being perpendicular to the grain direction, e.g. as much as two times higher. Therefore, it is possible to design cellulosic fiber substrates such that tensile and/or flexural and/or flexural strength is adapted to the intended use.

The cellulosic fibers of each of the at least one prepreg may also be oriented such that the cellulosic fibers are arranged in a crisscross shape. The at least one prepreg may then be arranged such that the grain direction of the cellulosic fibers of one of the at least one prepregs is perpendicular to the grain direction of the cellulosic fibers of the other of the at least one prepregs. The at least one prepreg may also be arranged such that the grain direction of the cellulosic fibers of one of the at least one prepregs is angled 0-90° to the grain direction of the cellulosic fibers of the other of the at least one prepregs, thereby realizing crisscross shapes with angles ranging from zero to right angle.

It is known that cellulosic fiber substrate comprising long cellulosic fibers, such as hemp, flax, ramie, and sisal can exhibit rather high tensile and/or flexural strength. It has been surprisingly found that the 3D article of the present invention comprising a cellulosic fiber substrate comprising short cellulosic fibers, i.e. cellulosic fibers having length of maximum 10 mm, preferably maximum 4 mm, exhibit the tensile and/or flexural strength being comparable to natural fiber cellulosic fiber substrate having long cellulosic fibers. At the same time, due to the fact that the short cellulosic fibers become impregnated by the binding agent, the article comprising short cellulosic fibers becomes water-repellant to a larger extent compared to an article comprising long cellulosic fibers. The term "water-repellant" means hydrophobic and/or having a density that prevents water from penetrating the material. Since the short cellulosic fibers are easily movable within the cellulosic fiber substrate during manufacturing, the layers are enabled to merge, as the fibers may "float" and fill cracks and tearing that may appear during manufacturing of cellulosic fiber substrates having complex surface structures. According to the present invention it is possible to manufacture cellulosic fiber substrates having small radii of curvature, which is a known problem in the area of creating complex 3D structures.

The cellulosic fiber substrate according to the present invention exhibits high moisture resistance due to the nature of the binding agent possibly in combination with the production process. Further, it has been found that the cellulosic fiber substrate according to the present invention when using PFA is self-extinguishable.

Further, it has been found that the cellulosic fiber substrate according to the present invention is inflammable and self-extinguishable. According to a glow wire test performed, in accordance with IEC 60695-2-12:2021, the cellulosic fiber substrate according to the invention when cured with PFA as a binding agent, passed the temperature test at 650° and 850° C. The cellulosic fiber substrate according to the present invention is fire resistant according to STD 104-0001/ISO3795, UV resistant according to STD 423-0061, scratch resistant according to STD 423-0030, heat resistant according to Volvo STD 423-0055, impact resistant according to EN 13087 and tested VOC free according to Volvo STD 429-0003. The density of the cellulosic fiber substrate according to the present invention was measured 1.34 g/cm$^3$ according to ISO11183, the glass transition temperature Tg was measured 145° C. according to ISO 11358 and the Charpy impact strenth was measured to be 8.6 KJ/m$^2$ according to ISO 179. Life cycle analysis calculations performed on the cellulosic fiber substrate according to the resent invention resulted in 0.65 kg$CO_2$-eq.

Examples of cellulosic fiber substrates of the present invention are sport appliances, such as helmets and skateboards, furniture items, such as chairs and tables, and vehicle parts, such as dashboards, door handles and interior parts. Further, cellulosic fiber substrates may be used in architecture and building, consumer electronics, major appliance, and the like.

The cellulosic fiber substrates of the present invention may thus replace currently available cellulosic fiber substrates comprising more expensive and less environmentally friendly materials, such as plastic and GFRP, without compromising, and in comparison with plastics and woods even improving, the tensile and flexural strength.

The cellulosic fiber substrates of the present invention have high moisture resistance, which is highly beneficial when the cellulosic fiber substrates are intended for outdoor use, or for use in a moist environment, such as a bathroom or in a humid climate. Further, the finishing of the surface of cellulosic fiber substrates of the present invention is highly decorative and aesthetically appealing and may further be adjusted to the desired application. In particular, the surface of the cellulosic fiber substrates may be shiny or dull. The cellulosic fiber substrates may have a gloss-satin finish, a matte finish, a rough surface, a patterned surface or have a surface with text or pictures on. The cellulosic fiber substrate and 3D articles manufactured therefrom according to the present invention may have various thicknessess over the entire detail or the same thickness over the entire detail.

The cellulosic fiber and substrate 3D articles manufactured therefrom according to the present invention may have a thickness of at least 1.5 mm, preferably at least 2.5 mm, preferably at least 5 mm, more preferably at least 10 mm. As is evident from above, the cellulosic fiber substrate of the present invention exhibits an unprecedented strength despite the relatively low thickness. The cellulosic fiber substrate thus combines low weight and slim structure with a great impact strength. The cellulosic fiber substrate 3D articles manufactured therefrom according to the present invention may also have a significantly greater thickness, such as a thickness of at least 20 mm, preferably at least 40 mm, more preferably at least 50 mm. Further, the total surface area of the cellulosic fiber substrate may be at least 0.1 $m^2$. In particular, the total surface area of the cellulosic fiber substrate may be from 0.3 $m^2$ to 100 $m^2$. In other words, the cellulosic fiber substrate may be rather large and still exhibit unprecedented strength, which enables using such articles for impact-absorbing applications.

The cellulosic fiber substrate of the present invention may be rigid. The term "rigid" in the context of the present invention is intended to mean as being deficient in or devoid of flexibility. The cellulosic fibers in the cellulosic fiber substrate may be provided in the form of a sheet.

The cellulosic fiber material from which the 3D article of the present invention is manufactured may be in the form of at least one layer of cellulosic fibers being impregnated with the binding agent. Further, the cellulosic fiber substrate from which the 3D article of the present invention is manufactured may be a stack of prepregs comprising at least two layers, preferably at least three layers. By the term "stack of prepregs" is understood a product made by laminating, i.e. by uniting superposed layers of one or more materials. Indeed, the stack of prepregs may comprise more than three layers, e.g., at least four, preferably at least five and more preferably at least six layers. Each of the layers preferably comprises the cellulosic fibers and the binding agent as described above.

It has surprisingly been found that the although the stack of prepregs constituting the cellulosic fiber substrate of the present invention comprises layers, the final cellulosic fiber substrate according to the present invention is perceived as being made of a homogenous cellulosic fiber substrate. Without wishing to be bound by a theory, such an effected is believed to be achieved due to the length of the cellulosic fibers being below 10 mm, preferably below 4 mm. As mentioned above, the short hydrophilic cellulosic fibers are substantially completely impregnated by the binding agent. Further, when the stack of prepregs is subjected to a high pressure and elevated temperature and formed into the cellulosic fiber substrate, almost no cracks are formed, since the cellulosic fibers may be rearranged without rupturing due to the short fiber length. The pressure may be at least 20 $kg/cm^2$, preferably at least 25 $kg/cm^2$, more preferably 30 $kg/cm^2$ and the temperature may be at least 60° C., preferably at least 140° C., more preferably at least 150° C. In particular, the temperature may be from 148° C. to 152° C. Further, even if a crack appears in one of the layers of the stack of prepregs, it may be filled by the cellulosic fibers from at least one of the adjacent layers of the stack of prepregs during the manufacturing process.

When a stack of prepregs is used, each layer of the stack of prepregs may be arranged relative the other layers such that the longitudinal extension of the fibers is adapted to the intended use of the resulting cellulosic fiber substrate.

Each of the layers of the stack of prepregs may have a thickness of from 0.01 mm to 10 mm. Indeed, the thickness of each layer depends on the total thickness of the cellulosic fiber substrate as described above. Thus, if the cellulosic fiber substrate comprises only one layer of cellulosic fiber substrate, the thickness of the layer is substantially equal to the thickness of the cellulosic fiber substrate. In a plurality of layers is present, the thickness of each layer may be same as or different from the thickness of the other layers in the stack of prepregs. The term "plurality" in the context of the present invention implies at least two.

The stack of prepregs disclosed above may be a high-pressure stack of prepregs (HPL). HPL is produced by saturating multiple layers of kraft paper comprising the cellulosic fibers with the binding agent.

The cellulosic fiber substrate according to the present invention may comprise at least one surface layer. By the term "surface layer" is in the context of the present invention is understood a layer being arranged on the surface of the cellulosic fiber substrate. Such a surface layer may be arranged in order to provide scratch resistance, UV resistance, food compatibility, aesthetic appearance, anti-bacterial property, color, surface structure, friction or any other functionality that may be desired.

A method for manufacturing a cellulosic fiber substrate by heat pressure molding may comprise the following steps:

a) providing at least one sheet of cellulosic fibers having a maximum length of 10 mm;
b) impregnating the at least one sheet of cellulosic fibers with a mix of an acidic curing catalyst and a binding agent selected form the group consisting of: cellulose, hemicellulose, furan, lignin and combinations thereof, to obtain at least one sheet of impregnated cellulosic fibers;
c) pre-curing the at least one sheet of impregnated cellulosic fibers by applying heat in the range of 50-300° C., thus obtaining a prepreg;
d) arranging one or more prepregs in a stack;
e) pressing said stack in a pressing tool at a pressure of at least 7 $kg/cm^2$, preferably at least 25 $kg/cm^2$, more preferably at least 30 $kg/cm^2$ and the temperature of at least 60° C., preferably at least 140° C., more preferably at least 150° C. during a time period of at least 10 seconds, preferably at least one minute, more preferably at least two minutes, thus obtaining a cellulosic fiber substrate having at least one top surface and one bottom surface.

The method described above may further comprise a step f) of edge cutting the cellulosic fiber substrate and a step h) of creating cavities in the cellulosic fiber substrate.

To summarize, the present invention provides cellulosic fiber substrates comprising cellulosic fibers, which is a natural, readily available, highly recyclable, and thus environmentally friendly and cost-efficient material. The surprising and unexpected effect of the present invention is that the mechanical properties, e.g. flexural and tensile strength of the cellulosic fiber substrate of the present invention is comparable to the tensile and/or flexural strength of the 3D articles manufactured from GFRP, yet being made of short cellulosic fibers in combination with a bio-based binder, which provides the freedom of design to create complex 3D surfaces especially comprising non-developable portions. Another advantage of the present invention is that by-products from food and agriculture industry are used as a binding agent, which contributes to circular economy and is environmentally benign.

While the present invention has been illustrated in the appended drawings and the foregoing description, such illustration is to be considered illustrative or exemplifying and not restrictive; the present invention is not limited to the disclosed embodiments. Other variations to the disclosed embodiments can be understood and effected by those skilled in the art in practicing the claimed invention, from a study of the drawings, the disclosure, and the appended claims. In the appended claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. A cellulosic fiber substrate, comprising:
at least one top surface, and
at least one bottom surface,
wherein the cellulosic fiber substrate further includes
60 to 90 wt % of cellulosic fibers having a length of maximum 10 mm,
0 to 10% of an acidic curing catalyst, and
10 to 40 wt % of a binding agent selected from the group consisting of:
cellulose, hemicellulose, furan, lignin and combinations thereof.

2. The cellulosic fiber substrate according to claim 1, wherein the binding agent is polyfurfuryl alcohol (PFA).

3. The cellulosic fiber substrate according to claim 1, wherein said cellulosic fibers comprise from 0-100% virgin cellulosic fibers and 0-100% recycled cellulosic fibers.

4. The cellulosic fiber substrate according to claim 1, wherein the at least one top surface and/or bottom surface has at least one developable and/or non-developable surface portion.

5. The cellulosic fiber substrate according to claim 1, wherein said cellulosic fibers in the cellulosic fiber substrate are arranged substantially parallel, or wherein said cellulosic fibers in the cellulosic fiber substrate are arranged substantially crisscrossed, or wherein said cellulosic fibers in the cellulosic fiber substrate are arranged substantially random, or said cellulosic fibers in the cellulosic fiber substrate are arranged in a combination thereof.

6. The cellulosic fiber substrate according to claim 1, wherein the cellulosic fiber substrate comprises at least one cavity.

7. A load bearing 3D article comprising the cellulosic fiber substrate according to claim 1.

8. The load bearing 3D article according to claim 7, wherein the load bearing 3D article has a tensile strength of at least 40 MPa.

9. The load bearing 3D article according to claim 8, wherein the load bearing 3D article has a thickness of at least 2.5 mm.

10. A method for manufacturing a cellulosic fiber substrate comprising at least one top surface and at least one bottom surface, the method comprising:

a) providing at least one sheet of cellulosic fibers having a maximum length of 10 mm;
b) impregnating the at least one sheet of cellulosic fibers with a mix of an acidic curing catalyst and a binding agent selected from the group consisting of: cellulose, hemicellulose, furan, lignin and combinations thereof, to obtain at least one sheet of impregnated cellulosic fibers;
c) pre-curing the at least one sheet of impregnated cellulosic fibers by applying heat in a range of 50-300° C., to obtain one or more prepregs;
d) arranging the one or more prepregs in a stack; and
e) pressing said stack in a pressing tool at a pressure of at least 7 kg/cm2 and a temperature of at least 60° C. during a time period of at least 10 seconds, to obtain the cellulosic fiber substrate having the at least one top surface and the at least one bottom surface,
wherein said cellulosic fiber substrate includes
60 to 90 wt % of said cellulosic fibers,
0 to 10 wt % of said acidic curing catalyst, and
10 to 40 wt % of said binding agent.

11. The method according to claim 10, wherein the binding agent is polyfurfuryl alcohol (PFA).

12. The method according to claim 10, wherein the cellulosic fibers comprise a mix of 0-100% virgin cellulosic and 0-100% recycled cellulosic fibers.

13. The method according to claim 10, wherein the cellulosic fibers are provided as paper.

14. The method according to claim 10, wherein the at least one top surface and/or the at least one bottom surface has at least one developable and/or non-developable surface portion.

15. The method according to claim 10, wherein said cellulosic fiber substrate has an amount of biobased carbon of at least 80%.

16. The method according to claim 10, wherein the one or more prepregs in the stack are oriented such that grain directions in the one or more prepregs are substantially parallel.

17. The method according to claim 10, wherein the one or more prepregs in the stack are oriented such that an angle of grain directions in the one or more prepregs range from 0-90° with respect to neighboring prepregs.

18. The method according to claim 10, further comprising step f) of cutting the one or more prepregs and/or the cellulosic fiber substrate into a pre-determined shape.

19. The method according to claim 10, further comprising step g) of creating cavities in the cellulosic fiber substrate.

* * * * *